United States Patent [19]

Deng

[11] Patent Number: 4,519,212

[45] Date of Patent: May 28, 1985

[54] BOILER-DRIVEN POWER GENERATOR

[76] Inventor: Shye-Yih Deng, 10-4 Fl., No. 62, Chang-Chun Rd., Taipei, Taiwan

[21] Appl. No.: 370,451

[22] Filed: Apr. 19, 1982

[51] Int. Cl.[3] ..... F01K 11/00

[52] U.S. Cl. ..... 60/669; 60/670; 415/199.5; 415/202

[58] Field of Search ..... 60/645, 669, 670; 122/161, 162, 135 F, 367 R, 438; 415/199.5, 202

[56] References Cited

U.S. PATENT DOCUMENTS

| | | | |
|---|---|---|---|
| 2,187,788 | 1/1940 | Kraft | 415/199.5 X |
| 3,312,065 | 4/1967 | Guin | 60/669 |
| 4,002,032 | 1/1977 | Bash | 60/669 X |

*Primary Examiner*—Stephen F. Husar

[57] ABSTRACT

A boiler driven power generator comprises a power generator directly driven by the expanded steam vapor inside a vaporizing chamber of a boiler to save energy as friction loss caused by the expanded steam vapors during vaporization.

1 Claim, 3 Drawing Figures

BOILER-DRIVEN POWER GENERATOR

BACKGROUND OF THE INVENTION

Conventional steam turbine may be driven by steam supplied from a boiler. As shown in FIG. 3, the steam is generated by vaporizing the water droplets Wd into steam vapors V in a conventional boiler Sb. During vaporization of such plurality of water droplets Wd, each droplet will be expanded in many times of volume to become a steam vapor V for doing pressure-volume work as phase change. The serious collision and friction between the expanded vapors may cause the friction loss F1. Other kind of friction loss F2 as piping system P delivered to a turbine T may also be caused. Hence, both friction losses F1, F2 will reduce the efficiency of a conventional steam turbine.

The present inventor has found the defects of a conventional turbine and invented the present boiler-driven power generator.

SUMMARY OF THE INVENTION

The object of the present invention is to provide a power generator directly driven by the expanded steam vapours inside a vaporizing chamber of a boiler to save energy as friction loss caused by the expanded steam vapours during vaporization.

DETAILED DESCRIPTION

Figure 1:
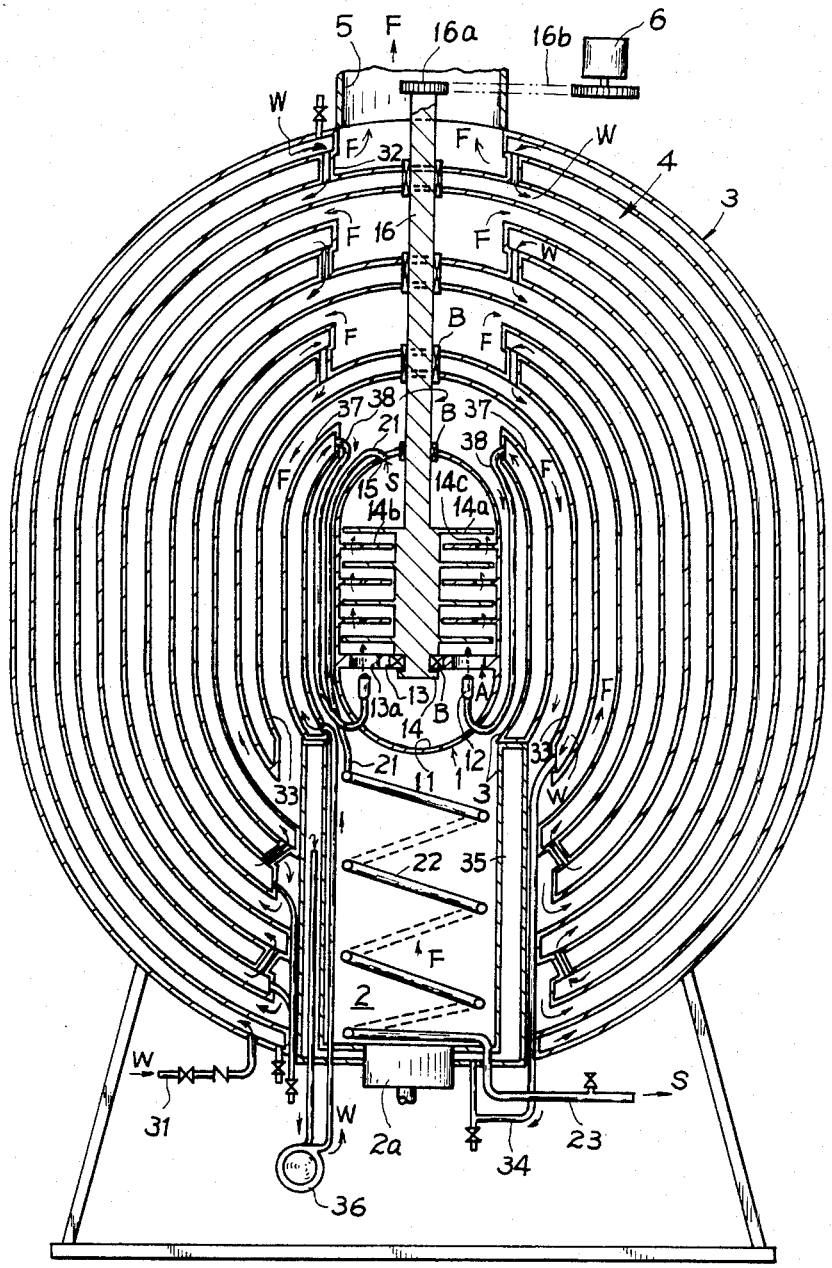
FIG. 1 is a sectional drawing of the present invention.
Figure 2:
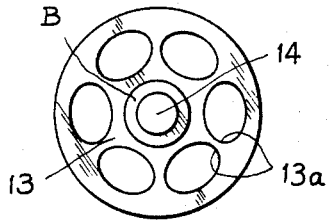
FIG. 2 is an illustration of the defining plate of the present invention taken from direction A of FIG. 1.
Figure 3:
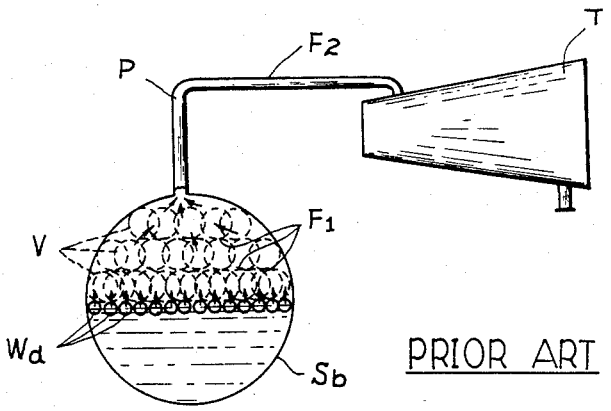
FIG. 3 is an illustration showing the arrangement of conventional boiler with turbine.

As shown in FIG. 1 and FIG. 2, the present invention comprises a rotor 14 having several blades 14*a*, which is pivotedly installed within a vaporizing chamber 1 of a safety boiler with high efficiency and granted as U.S. Pat. No. 4,407,235 which comprises a plurality of water jackets 3 disposed around the central vaporizing chamber 1 positioned atop on a combustion chamber 2; a plurality of sandwiched flues 4 each respectively partitioned between each two neighboring water jackets; several atomizers 12 respectively connected to an innermost water jacket 37 communicated with the water jackets 3; and a steam pipe 21, poking into the vaporizing chamber 1, which is connected with a coil 22 formed in the combustion chamber 2 and a discharge pipe 23 for discharging end use, whereby the feed water passing through the water jackets 3 is heated and sprayed from the atomizers 12 to vaporize as steam, and the generated steam is led into the coil 22 for superheating and discharged through discharge pipe 23 for end use.

Rotor 14 is pivotedly installed within vaporizing chamber 1 by bearings B. A defining plate 13 with central bearing B is provided beyond the atomizers 12 inserted into vaporizing chamber 1 to rotatably mount one end of rotor 14. Defining plate 13 is formed with several injection holes 13*a* thereon to allow the inlet of water mists sprayed by several atomizers 12 provided in vaporizing chamber 1. Rotor 14 is passed through a bearing B formed on the casing 11 of vaporizing chamber 1 and extending on its other end connects a transmission shaft 16 at the end opposite to atomizers 12. A steam outlet port 15 is formed on said casing 11 at the end opposite to are atomizers 12. Several diaphragms 14*b* are respectively extend from casing 11, each diaphragm is formed with several nozzles 14*c* for passing steam vapour therethrough and each diaphragm partitions the two neighboring blades 14*a* of rotor 14. Casing 11 may be formed as a cylindrical shape or other sutiable shapes for containing rotors 14, blades 14*a* and diaphragms 14*b* therein.

Vaporizing chamber 1 is positioned centrally of the boiler and positioned above or aside of a combustion chamber 2 which comprises a burner 2*a*, a steam pipe 21 connected to a steam port 15, a coil 22 for superheating the steam therein and a steam discharge pipe 23. Atomizers 12 in vaporizing chamber 1 is positioned near the combustion chamber 2 and transmission shaft 16 of rotor 14 is positioned near the stack 5.

Vaporizing chamber 1 is disposed by several water jackets 3. Several flues 4 are provided in the boiler, each is sandwiched between each pair of two neighboring jackets 3. A stack 5 is communicated with the flues 4 to exhaust the flue gas F therefrom. Transmission shaft 16 passes through all jackets 3 is terminated in stack 5 by a gear 16*a* and a chain 16*b* which is coupled to a power generator 6. Shaft 16 is freely passing all bearings B formed on the water jackets 3.

Water jackets 3 are gradually disposed vaporizing chamber 1. A water inlet pipe 31 is provided to lead feed water W into the outermost water jacket. The water is led through water jackets 3, jacket 33, jacket 37 and jacket 35 surrounding combustion chamber 2. A boosting pump 36 is provided to connect jacket 35 with jacket 37. Several connecting pipes 38 are provided to connect jacket 37 with said atomizers 12 to charge the heated water mist into atomizers 12 for steam generation.

When operating the present invention, the combustion heat from combustion chamber 2 will heat vaporizing chamber and the pressurized water through pipes 38 so as to vaporize the water mists sprayed from atomizers 12. The instant expanded vapour will force the blades 14*a* to rotate rotor 14 and shaft 16 for driving power generator 6.

The principle of the boiler may refer to the corresponding application, "Safety Boiler with High Efficiency" as enclosed herewith.

The advantages of the present invention superior to any conventional turbine are described as follows:

1. The pressure-volume work done by the expanded vapours in vaporizing chamber 1 will not be lost as frictional loss and will instantly force rotor for power generation for saving energy.

2. The steam in vaporizing chamber 1 exists in a high-temperature condition and will not cause condensation to affect the rotor operation.

3. The friction loss caused in piping system of conventional steam turbine will be saved in the present invention.

4. The generated steam, after being used to drive the power generator, may still be discharged for any end use as usual.

The position or orientation of transmission shaft 16 and atomizers 12 may also be opposite to that as figure shown and may be suitably modified in any practical application.

The power generated by the present invention may be partially or fully consumed to drive the auxiliary equipments of the boiler, such as: blower, boosting pump or control systems to render the self-supplied energy sources to save energy.

The rotor, diaphragms, and transmission shaft may be replaced with a piston-actuated engine for power output.

I claim:

1. A boiler-driven power generator being formed within a vaporizing chamber of a boiler which comprises:

a plurality of water jackets disposed around said central vaporizing chamber positioned atop on a combustion chamber;

a plurality of sandwiched flues each respectively partitioned between each two neighboring water jackets; several atomizers respectively connected to an innermost water jacket communicated with said water jackets; and a steam pipe, poking into said vaporizing chamber, which is connected with a coil formed in said combustion chamber and a discharge pipe for discharging end use, the improvement which comprises:

a rotor pivotedly installed in a casing of said vaporizing chamber of the boiler and extending several blades therefrom; several diaphragms respectively extending inwards from the casing of said vaporizing chamber, each diaphragm partitioning the two neighbouring blades of said rotor and each diaphragm being formed with several nozzles thereon for passing steam therethrough;

a transmission shaft connected to one end of said rotor and terminated with a gear and a chain to couple a power generator; and a defining plate being positioned beyond said atomizers inserted into said vaporizing chamber of the boiler for rotatably mounting another end of said rotor, and formed with several injection holes for passing steam sprayed and vaporized from said atomizers, whereby the feed water is heated when passing through said water jackets and sprayed through said atomizers to vaporize as steam to force said blades to rotate said rotor and transmission shaft for driving said power generator and the exhausted steam from said vaporizing chamber is led into said steam pipe, coil and discharged through said discharge pipe.

* * * * *